US010890319B2

(12) United States Patent
McMillan

(10) Patent No.: US 10,890,319 B2
(45) Date of Patent: Jan. 12, 2021

(54) PASSIVE AIR HANDLER TROFFER LIGHT

(71) Applicant: George Erik McMillan, Hickory, NC (US)

(72) Inventor: George Erik McMillan, Hickory, NC (US)

( * ) Notice: Subject to any disclaimer, the term of this patent is extended or adjusted under 35 U.S.C. 154(b) by 0 days.

(21) Appl. No.: 15/952,981

(22) Filed: Apr. 13, 2018

(65) Prior Publication Data

US 2018/0299118 A1 Oct. 18, 2018

Related U.S. Application Data

(60) Provisional application No. 62/485,205, filed on Apr. 13, 2017.

(51) Int. Cl.

| | |
|---|---|
| ***F21V 33/00*** | (2006.01) |
| ***F21V 7/00*** | (2006.01) |
| *F21S 8/02* | (2006.01) |
| *F21Y 115/10* | (2016.01) |

(52) U.S. Cl.

CPC ..... *F21V 33/0088* (2013.01); *F21V 7/0066* (2013.01); *F21S 8/026* (2013.01); *F21Y 2115/10* (2016.08)

(58) Field of Classification Search

CPC .... F21V 33/0088; F21V 7/0066; F21V 29/70; F21V 33/00; F21Y 2115/10; F21Y 2103/10; F21S 8/026; F21S 9/02; F21S 2/005; H01L 2924/00; A61L 2209/12; F21W 2121/00

USPC ..... 362/96

See application file for complete search history.

(56) References Cited

U.S. PATENT DOCUMENTS

| | | | | |
|---|---|---|---|---|
| 2,991,708 | A * | 7/1961 | Falk | F21V 33/0088 362/294 |
| 3,259,052 | A * | 7/1966 | Bradley | F21V 33/0092 165/185 |
| 3,710,094 | A * | 1/1973 | Monte | F21V 29/83 362/218 |
| 2009/0290348 | A1* | 11/2009 | Van Laanen | F21V 3/02 362/249.02 |
| 2015/0043208 | A1* | 2/2015 | Engelhardt | F21V 3/04 362/241 |

* cited by examiner

*Primary Examiner* — Cara E Rakowski
*Assistant Examiner* — Jessica M Apenteng
(74) *Attorney, Agent, or Firm* — Ascentage Patent Law, LLC; Travis Lee Johnson

(57) ABSTRACT

In one aspect, a troffer light fixture includes a troffer body shaped to reflect or disperse light from a light source that includes LEDs attached to a first side of the troffer body. The troffer body includes two or more vents that are configured to pass air from the first side of the troffer body to open space on a second side of the troffer body for a duct-less HVAC air intake.

10 Claims, 4 Drawing Sheets

PASSIVE AIR HANDLER TROFFER LIGHT

RELATED APPLICATIONS

This application claims priority from U.S. Provisional Appl. No. 62/485,205, filed Apr. 13, 2017, the contents of which are incorporated herein in their entirety.

TECHNICAL FIELD

The present invention generally relates to troffer lights and air handling by heating, ventilation, and air conditioning (HVAC) systems.

BACKGROUND

An HVAC system of an environmentally controlled building will have an air handler that pushes and pulls air through the HVAC system and through the building. This pushing and pulling of the air is done via duct work. For example, in large facilities, each room has an "air supply" (exhaust vent) that supplies the heated or cooled air, and a "return" (air intake) where air is ducted back to the HVAC source. Both the air supply and the air return utilize specific air ducts to guide and control the air.

The draw-back to this design is that dirt, debris and moisture are drawn through a multitude of return ducts, where it accumulates and often creates the perfect breeding ground for fungi, mold and other toxic biologicals. As there are many individual ducts, it is very difficult to keep the return air clean, or to keep the ducts free of contaminates. Also, if a room has many ceiling fixtures, some will be normal light fixtures, while others will be specially designed to return air through a duct. In most cases, the return light fixtures are noticeably different and take away from the aesthetics of the ceiling.

The HVAC industry is now implementing a newer form of an air handler. This new HVAC system does not rely on return ducts to guide and determine flow to an individual room of a building. This new system utilizes the space above the ceiling (drop ceiling) as the air return and only needs a large opening in the ceiling for air to pass through. For example, a drop ceiling tile with an opening is all that is required for the air return. This opening allows air to freely pass from below the ceiling (or from the living area), to above the ceiling, where it is pulled towards the air handler. As there is no duct work leading to the air handler via multiple locations, this allows for four distinct advantages over the existing duct-type HVAC systems. First, it eliminates the accumulation of debris and moisture within a confined area that cause harmful biological toxins to build up and enter the HVAC system. Second, it reduces costs by eliminating 50% of HVAC duct work, or 100% of the return ducting. Third, this design allows for the use of a complete and efficient intake filtering system, cleaning all air prior to entering the HVAC. Fourth, it reduces the time and expense required to engineer and install the HVAC system.

With this new air handler, the accepted practice for a drop ceiling application is to simply replace ceiling tiles with open grates as pathways for the air to pass from below the ceiling to above the ceiling and onto a filter of the air handler. It is a simple approach to an HVAC return, but again, not very pleasing aesthetically.

As this newer HVAC system popularity is growing, another technology is also becoming more popular—Light-Emitting Diode (LED lighting). In the lighting industry, there are several lighting applications that have incorporated HVAC needs into light fixtures. There are a few fluorescent and LED fixtures that include troffers that offer an active air supply or active air return for existing HVAC systems. That is, an air supply light fixture incorporates the supply ducting of an older HVAC system. The air return light fixture then uses the HVAC system's return ducting. With regard to the newer non-ducted return HVAC systems, there is no lighting answer that works well with such systems, because existing HVAC-incorporated light fixtures are specially created for ducted HVAC systems.

SUMMARY

Embodiments of the present invention include troffer light fixtures designed for HVAC systems with a non-ducted return. These troffer light fixtures minimize or eliminate the unpleasant appearance of the ceiling grates and provide air passageways that are unnoticeable and "camouflaged" into the ceiling. Such troffer light fixtures are also advantageous when combined with LEDs, which are growing in popularity.

According to some embodiments, a troffer light fixture includes a troffer body shaped to reflect or disperse light from a light source and the light source, where the light source comprises one or more LEDs attached to a first side of the troffer body. The troffer body includes two or more vents that are configured to pass air from the first side of the troffer body to open space on a second side of the troffer body.

The two or more vents may be formed into two or more rows on either side of the light source. The two or more rows may extend along the length of the troffer body. The two or more rows may be proximate to edges of the troffer body. Each of the two or more rows may include at least three vents. In some cases, the two or more vents are not visible to view from below the first side of the troffer body.

Of course, the present invention is not limited to the above features and advantages. Those of ordinary skill in the art will recognize additional features and advantages upon reading the following detailed description, and upon viewing the accompanying drawings.

DETAILED DESCRIPTION

What is needed is a new lighting fixture that is specifically designed as a 'passive' vent return directly created for a ductless HVAC air handler system. The troffer lights described in the embodiments provide for a more aesthetically pleasing passive air return for non-ducted return HVAC systems.

The troffer lights also offer a scalable solution. The larger the room, the more lights are needed for lighting. A larger room also requires a means for more air to transfer to the HVAC. As every "passive return" troffer light allows for a given amount of air to pass, the more lights required to light a room, the more airflow is allowed to pass. That is, the room size dictates both the number of light fixtures required for that room or area, as well as the amount of airflow needed. The troffer lights are a nice union between the HVAC and LED lighting technologies.

An example of a troffer light fixtures is described below. The troffer light fixture provides a clean and efficient solution for duct-less HVAC systems that can combine well with newer lighting technologies. For example, an LED troffer light can include a neat row of perforated vents that follow the length of the troffer on each side. The efficiency of the design is cost effective and visually pleasing. The addition of the perforated vents, and their functionality, may go unnoticed or may not be visible to view. If the perforated vents are noticed, they may appear to be a smart, aesthetic addition to the troffer light fixture design.

Figure 1:
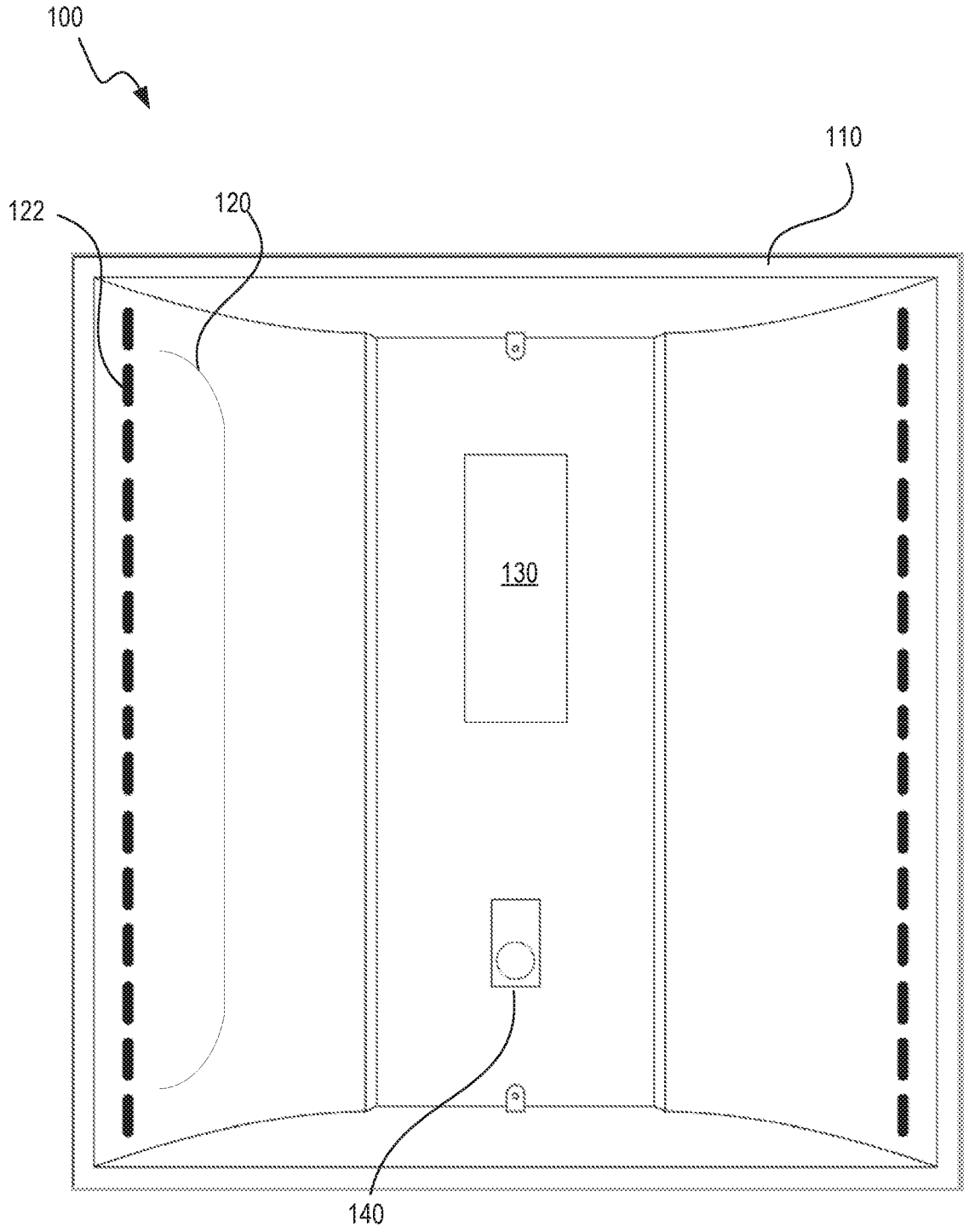
FIG. 1 is an illustration of a 2×2 indirect troffer light fixture, according to some embodiments.

FIG. 1 is an illustration of an indirect troffer light fixture 100, according to an example embodiment. The troffer light fixture 100 may include a troffer body 110 that encompasses a light source, such as LED light source 130. The LED light source 130 may include one or more LEDs attached to a first side of the troffer body 110. The emitters in LED light source 130 may be controlled by controller 140. The troffer body 110 is shaped to reflect or disperse light from the LED light source 130.

The troffer body 110 also includes one or more vents configured for passing air. For example, when the troffer light fixture 100 is installed in a ceiling, such as a drop ceiling, the air below the ceiling may pass from below the ceiling, through the vents, and to an open space above the ceiling. The air may then be collected by an air handler of an HVAC system designed with a duct-less return. No ducts are attached to the troffer light fixture 100.

Figure 2:
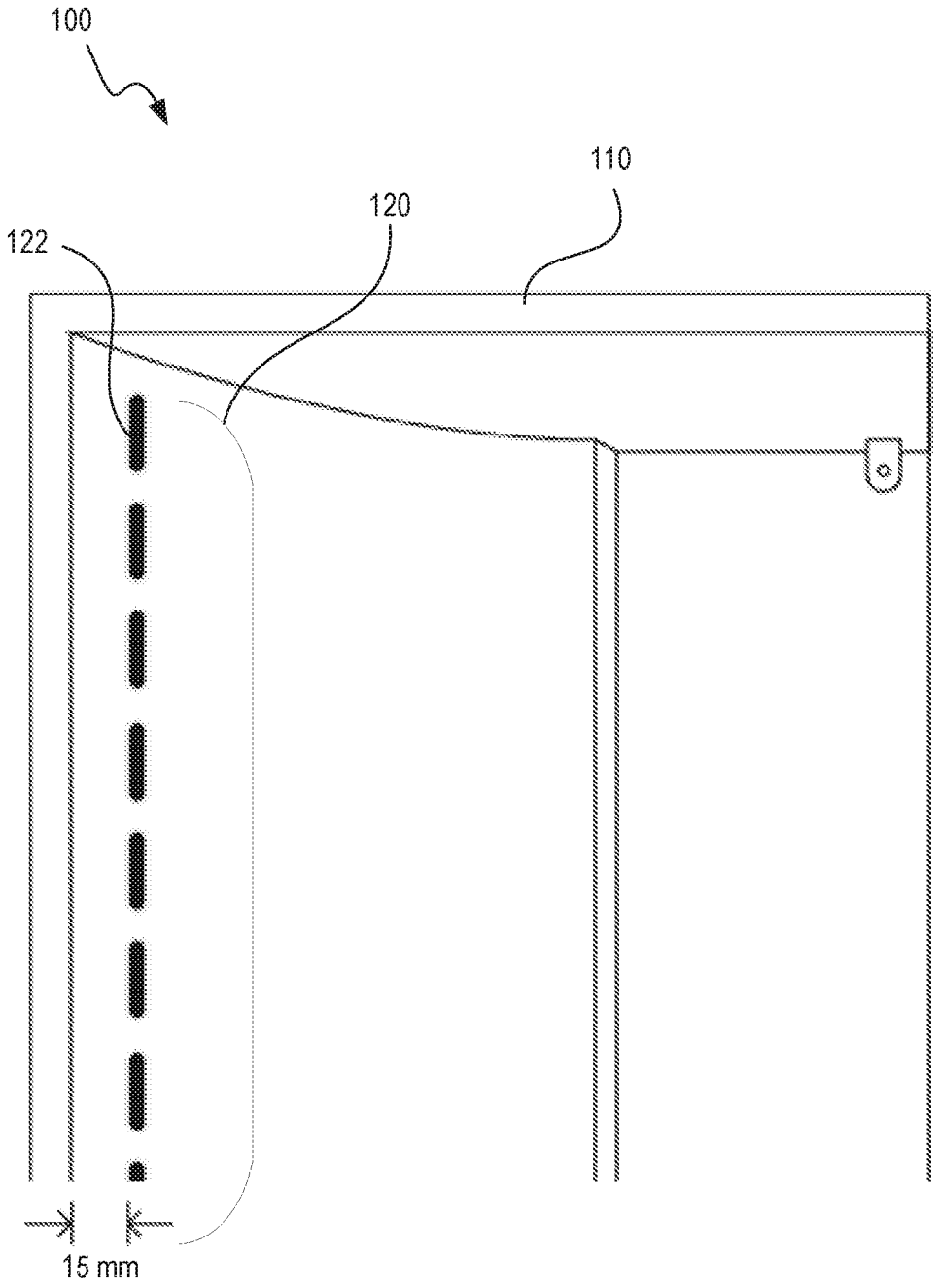
FIG. 2 illustrates a close-up view of perforated vents in the troffer light fixture, according to some embodiments.

In the example troffer light fixture 100 of FIG. 1, there are multiple vents 122 that perforate the troffer body 110. The vents 122 may be arrayed in one or more rows 120. FIG. 2 is a close-up view of a row 120 of the perforated vents 122. The perforated vents 122 may be lined up single-file in the row 120 and the row 120 may extend the length of the troffer body 110. The row 120 may be located near the edge of the troffer light body 110. There may be a matching row of perforated vents on the opposite side, so as to form a symmetrical pattern. The number of rows and/or the orientation of the rows may vary and are not limited to the rows 120 illustrated in the figures.

The size, shape and number of the perforated vents 122 may vary based on the amount of air that must pass through the troffer body 110. In some cases, there may be 30 perforated vents 122 altogether, such as shown in FIG. 1. In other cases, the perforated vents 122 may be longer and fewer in number. The shapes of the perforated vents 122 may be thin ellipses, as shown in FIG. 1. In other cases, the perforated vents 122 may be rectangular or follow another pattern. The design of the rows 120 of perforated vents 122 may vary according to the aesthetic design chosen for the troffer light fixture 100, as long as the rows 120 of perforated events 122 provide for the proper passage of air for a duct-less HVAC system.

According to some embodiments, the perforated vents 122 are configured to pass air from the first side (e.g., bottom side) of the troffer body 110 to open space on a second side (e.g., top side) of the troffer body 110, or vice versa. Open space means that the air passing through the vents flows freely to an air space above the troffer body so that it may be taken up in an air intake of a duct-less HVAC system, without any duct conducting the air between the troffer body and the HVAC air-intake handler.

Figure 3:
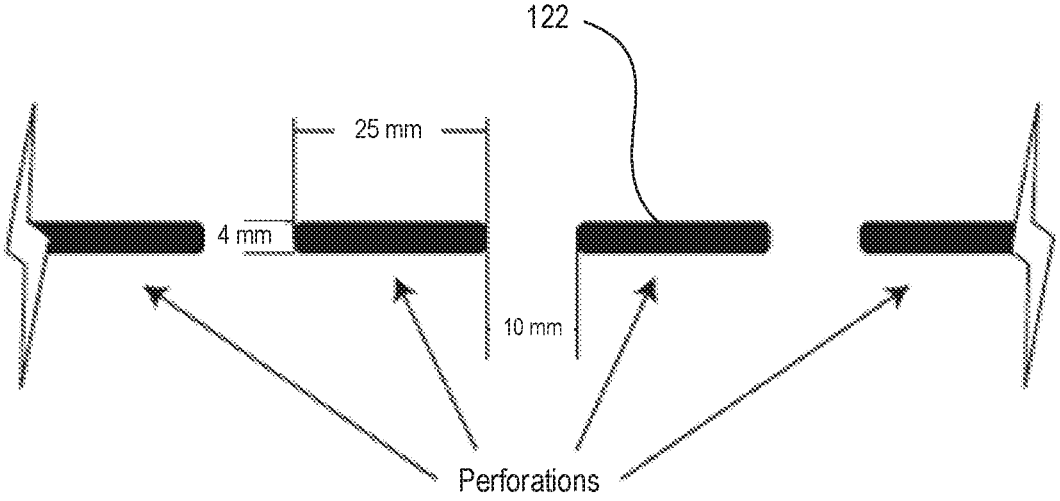
FIG. 3 is another illustration of perforated vents, according to some embodiments.
Figure 4:
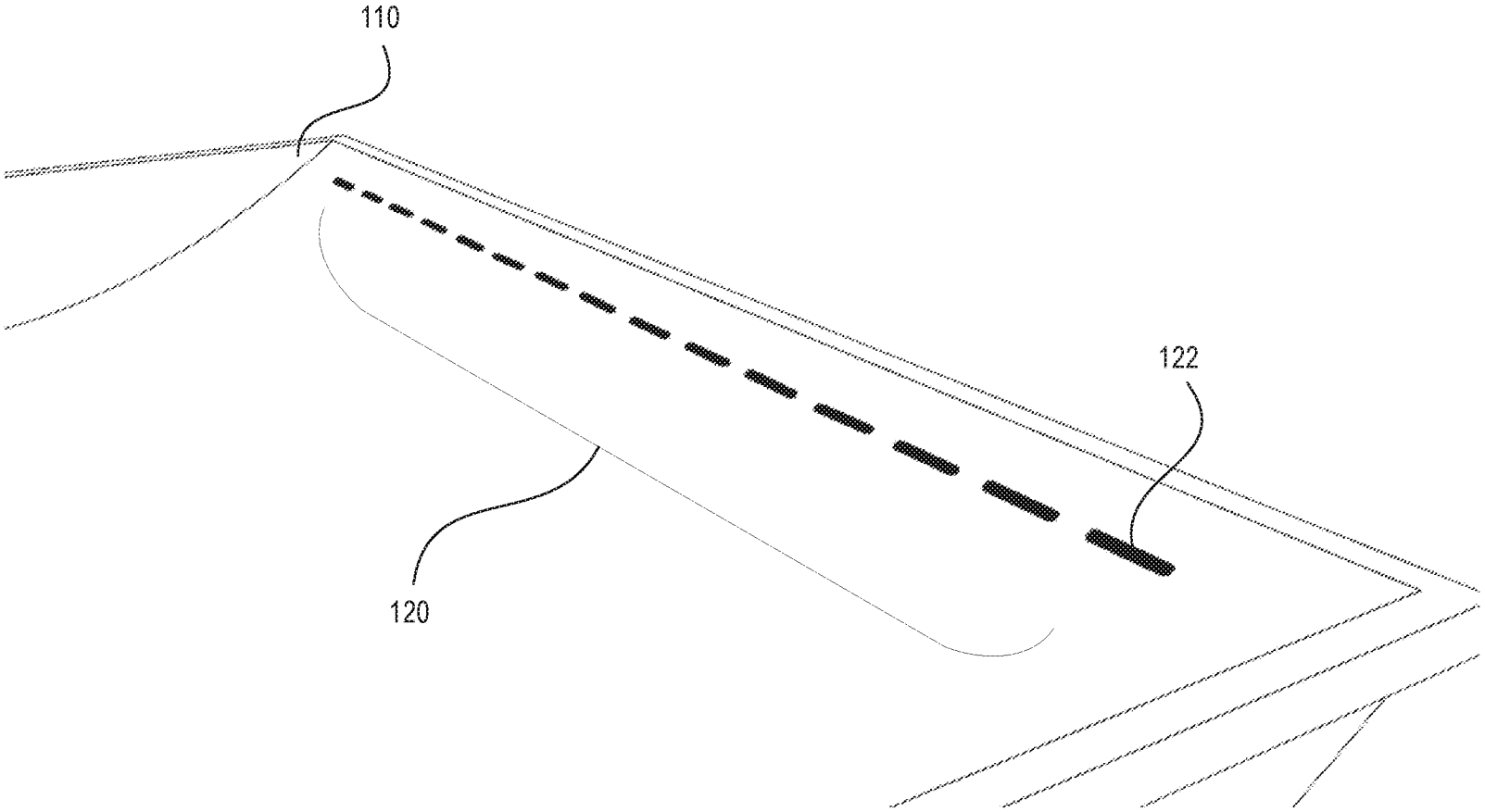
FIG. 4 illustrates a perspective view of the troffer light fixture, according to some embodiments.

FIG. 3 is another view of perforated vents, according to some embodiments. FIG. 4 illustrates a perspective view of the troffer light fixture, according to some embodiments.

Notably, modifications and other embodiments of the disclosed invention(s) will come to mind to one skilled in the art having the benefit of the teachings presented in the foregoing descriptions and the associated drawings. Therefore, it is to be understood that the invention(s) is/are not to be limited to the specific embodiments disclosed and that modifications and other embodiments are intended to be included within the scope of this disclosure. Although specific terms may be employed herein, they are used in a generic and descriptive sense only and not for purposes of limitation.

What is claimed is:

1. A troffer light fixture configured to be installed in a ceiling, comprising:

a troffer body shaped to reflect or disperse light from a light source; and the light source, wherein the light source comprises one or more light emitting diodes (LEDs) attached to a first side of the troffer body, and wherein the troffer body comprises two or more vents that are configured to pass air from below the ceiling and from just under the first side of the troffer body to open space on a second side of the troffer body, wherein the open space is above the ceiling and outside the troffer light fixture, and wherein the troffer light fixture is configured to allow the air to flow unrestricted from below the ceiling and from just under the first side of the troffer body to the two or more vents without the air flowing directly past the light source.

2. The troffer light fixture of claim 1, wherein the two or more vents are formed into two or more rows on either side of the light source, wherein each of the two or more vents is one aperture, and wherein the two or more vents lie end to end in each of the two or more rows.

3. The troffer light fixture of claim 2, wherein the two or more rows extend along the length of the troffer body.

4. The troffer light fixture of claim 3, wherein the two or more rows are proximate to opposite edges of the troffer body.

5. The troffer light fixture of claim 3, wherein each of the two or more rows comprise at least three vents.

6. The troffer light fixture of claim 1, wherein the two or more vents are not visible when viewed from below the first side of the troffer body.

7. The troffer light fixture of claim 2, wherein the two or more vents are configured for the proper passage of air to open space above the ceiling for an air handler of a ductless heating, ventilation and air conditioning (HVAC) system.

8. A troffer light fixture configured to be installed in a ceiling, comprising:

a troffer body shaped to reflect or disperse light from a light source; and the light source, wherein the light source comprises one or more light emitting diodes (LEDs) attached to a first side of the troffer body, and wherein the troffer body comprises a first row of vents spaced along a first side of the troffer body and second row of vents spaced along a second side of the troffer, wherein the first row of vents and the second row of vents are parallel to each other and are configured to pass air from below the ceiling and from just under the first side of the troffer body to open space on a second side of the troffer body, wherein the open space is above the ceiling and outside the troffer light fixture, and wherein the troffer light fixture is configured to allow the air to flow unrestricted from below the ceiling and from just under the first side of the troffer body to the first row of vents and the second row of vents without flowing directly by the light source.

9. The troffer light fixture of claim 8, wherein the first row of vents extends along a length of the troffer body.

10. The troffer light fixture of claim 8, wherein the second row of vents extends along a length of the troffer body.

* * * * *